US010358724B2

(12) United States Patent
Lee et al.

(10) Patent No.: US 10,358,724 B2
(45) Date of Patent: Jul. 23, 2019

(54) ELECTROLESS NICKEL PLATING SOLUTION, ELECTROLESS NICKEL PLATING METHOD USING SAME, AND FLEXIBLE NICKEL PLATED LAYER FORMED BY USING SAME

(71) Applicant: KOREA INSTITUTE OF INDUSTRIAL TECHNOLOGY, Chungcheongnam-do (KR)

(72) Inventors: Hongkee Lee, Incheon (KR); Junmi Jeon, Chungcheongnam-do (KR)

(73) Assignee: KOREA INSTITUTE OF INDUSTRIAL TECHNOLOGY, Chungcheongnam-Do (KR)

( * ) Notice: Subject to any disclaimer, the term of this patent is extended or adjusted under 35 U.S.C. 154(b) by 645 days.

(21) Appl. No.: 14/905,376

(22) PCT Filed: Jul. 1, 2014

(86) PCT No.: PCT/KR2014/005847
§ 371 (c)(1),
(2) Date: Jan. 15, 2016

(87) PCT Pub. No.: WO2015/008952
PCT Pub. Date: Jan. 22, 2015

(65) Prior Publication Data

US 2016/0168718 A1 Jun. 16, 2016

(30) Foreign Application Priority Data

Jul. 16, 2013 (KR) ..... 10-2013-0083856

(51) Int. Cl.
*C23C 18/32* (2006.01)
*C23C 18/36* (2006.01)
*C23C 18/34* (2006.01)

(52) U.S. Cl.
CPC ..... *C23C 18/32* (2013.01); *C23C 18/34* (2013.01); *C23C 18/36* (2013.01)

(58) Field of Classification Search
None
See application file for complete search history.

(56) References Cited

U.S. PATENT DOCUMENTS 2,929,742 A * 3/1960 De Minjer ..... C23C 18/36 106/1.27
3,754,940 A * 8/1973 Kadison ..... C23C 18/40 106/1.26
3,915,716 A * 10/1975 Haack ..... C23C 18/34 106/1.22
4,209,331 A * 6/1980 Kukanskis ..... C23C 18/40 106/1.23
4,686,015 A * 8/1987 Samuels ..... C25D 3/56 205/126
5,910,340 A * 6/1999 Uchida ..... C23C 18/42 106/1.22
2011/0192316 A1* 8/2011 Chou ..... C23C 18/34 106/1.22

FOREIGN PATENT DOCUMENTS

| | | |
|---|---|---|
| CN | 1311349 | 9/2001 |
| CN | 1936079 | 3/2007 |
| CN | 102321880 | 1/2012 |
| CN | 102392235 | 3/2012 |
| CN | 102400120 | 4/2012 |
| CN | 102994988 | 3/2013 |
| JP | 05-295557 | 11/1993 |
| JP | 08-176837 | 7/1996 |
| KR | 10-2009-0017744 | 2/2009 |
| KR | 10-2011-0113349 | 10/2011 |

OTHER PUBLICATIONS

Office Action dated Dec. 30, 2016 in Chinese Patent Application No. 201480040158.X.
Search Report dated Dec. 8, 2016 in Chinese Patent Application No. 201480040158.X.
Chinese Office Action from corresponding Chinese Patent Application No. 201480040158.X dated Aug. 10, 2017.
Surface Process Engineering Setting, "3.3.1 Basic principle of electroless plating", dated May 31, 2011, p. 141-142, and its English translation.
International Search Report dated Sep. 23, 2014 in PCT/KR2014/005847 published as WO 2015/008952, with English translation.

* cited by examiner

*Primary Examiner* — Sheeba Ahmed
(74) *Attorney, Agent, or Firm* — Harness, Dickey & Pierce, P.L.C.

(57) ABSTRACT

The present invention provides an electroless nickel plating solution supplying high flexibility to a plated layer and having improved stability. The electroless nickel plating solution according to an embodiment of the present invention is an electroless nickel plating layer using an electroless nickel plating method. The electroless nickel plating solution comprises: a nickel metal salt providing a nickel ion for plating, and containing sulfamic acid nickel; a reducer reducing the nickel ion for plating; a complexing agent forming a complex together with the nickel ion for plating; and a cyan-based stabilizer providing stability of the electroless plating solution and preventing the generation of pits in a flexible nickel plated layer.

19 Claims, 5 Drawing Sheets

ELECTROLESS NICKEL PLATING SOLUTION, ELECTROLESS NICKEL PLATING METHOD USING SAME, AND FLEXIBLE NICKEL PLATED LAYER FORMED BY USING SAME

CROSS-REFERENCE TO RELATED APPLICATIONS

This application is a national phase application of PCT Application No. PCT/KR2014/005847, filed on 1 Jul. 2014, which claims benefit of Korean Patent Application 10-2013-0083856, filed on 16 Jul. 2013. The entire disclosure of the applications identified in this paragraph are incorporated herein by reference.

FIELD

The technical concept of the present invention relates to electroless plating, and more specifically relates to an electroless nickel plating solution, an electroless nickel plating method using the electroless nickel plating solution, and a flexible nickel plated layer produced using the electroless nickel plating method.

BACKGROUND

Electroless plating is a method by which a metal plated layer is formed on an object to be plated through an oxidation-reduction reaction of a metal, and since plating is possible irrespective of the shape of a product, and since after undergoing a particular pretreatment process, even an insulating material may be plated, electroless plating is used in various industrial sectors.

The importance in the materials and components industry of surfaces plated through electroless plating is steadily increasing, such plated surfaces being used in various areas of packaging as a mounting surface or a junction interface, and the like, of micro elements having a high density. Recently, in accordance with efforts to produce electronic products that are lighter, smaller, and have a higher functionality, there has been a demand for increasing the density and narrowing the pitch of internal circuits, and consequently, the need is increasing for an electroless plating method that is not affected by plating area or product shape, and has a small variance in the thickness of the plated layer.

In particular, since a plating film formed through the electroless nickel plating method may control the amount of phosphorous that is precipitated and formed through a eutectoid reaction, the plated layer including an amorphous metal alloy may be formed, the plated layer having a uniform surface may be obtained, and the plated layer having excellent corrosion resistance and wear resistance, and the like, may be formed. Thus, electroless nickel plating is being widely applied as the plating technique used in the final surface treatment of automobiles, precision machine components, semiconductors, and printed circuit boards (PCB), and the like. Moreover, the areas of application are becoming broader, such as being used for treating failures in soldering joints in printed wiring boards or in the primary treatment of compact disks (CD) or hard disk drives (HDD).

In particular, unlike a rigid printed circuit board in which the materials are hard, since a flexible printed circuit board that uses an insulting film is thin and flexible, and thus enables smaller and lighter electronic components, the quantity of flexible printed circuit boards being used is increasing. When the flexible printed circuit board is used, since complex electronic circuits may be realized on the flexible insulating film, a useful solution may be provided with respect to improving quality, reducing size, and narrowing the pitch of the line width in electronic products, and thus the range and quantity used in mobile phones, digital cameras, notebook PCs, smartphones, tablets, PCs, and the like, is increasing.

As such, as the quantity of flexible printed circuit boards being used increases, there is a need for research about methods for plating flexible printed circuit boards. A typical electroless nickel plated layer has a high hardness, and excellent corrosion resistance and wear resistant properties, but has a poor percent elongation such that fracturing may easily occur, and thus there is a limitation to the application of flexible printed circuit boards. Moreover, since commercial high-flexibility electroless nickel plating solutions lack stability and the properties of the plated layer change according to the number of times the solutions are used, there is a limitation in that the lifetime of the plating solution is short.

DISCLOSURE OF THE INVENTION

Technical Problem

A technical object to be achieved by the technical concept of the present invention is to provide an electroless nickel plating solution that provides a high flexibility to a plated layer and has an improved stability.

A technical object to be achieved by the technical concept of the present invention is to provide an electroless nickel plating method using an electroless nickel plating solution that provides a high flexibility to a plated layer and has an improved stability.

A technical object to be achieved by the technical concept of the present invention is to provide a flexible nickel plated layer formed using the electroless nickel plating solution.

However, such objects are merely examples, and the technical concept of the present invention is not limited thereto.

Technical Solution

An electroless nickel plating solution according to a technical concept of the present invention for achieving the technical object forms a flexible nickel plated layer by using an electroless nickel plating method, and the electroless nickel plating solution includes a nickel metal salt that provides a nickel ion used for plating, and contains sulfamic acid nickel; a reducer that reduces the nickel ion used for plating; a complexing agent that forms a complex with the nickel ion used for plating; and a cyan-based stabilizer that provides stability to the electroless nickel plating solution and prevents the generation of pits in the flexible nickel plated layer.

In some embodiments of the present invention, the nickel metal salt may be included in the range of 4 g to 7 g per 1 liter of the electroless nickel plating solution.

In some embodiments of the present invention, the reducer may include at least one of sodium hypophosphite, potassium hypophosphite, or ammonium hypophosphite; and the reducer may be included in the range of 20 g to 50 g per 1 liter of the electroless nickel plating solution.

In some embodiments of the present invention, the complexing agent may include at least one of carboxylic acid, alpha hydroxyl acid, or amino acid; and the complexing agent may be included in the range of 40 g to 80 g per 1 liter of the electroless nickel plating solution.

In some embodiments of the present invention, the complexing agent may include, per 1 liter of the electroless nickel plating solution: carboxylic acid or a derivative thereof in the range of 5 g to 20 g; alpha hydroxyl acid or a derivative thereof in the range of 5 g to 20 g; and amino acid or a derivative thereof in the range of 5 g to 100 g.

In some embodiments of the present invention, the complexing agent may include, per 1 liter of the electroless nickel plating solution: a sum of adipic acid and tartaric acid in the range of 5 g to 20 g; lactic acid in the range of 5 g to 20 g; and glycine in the range of 5 g to 100 g.

In some embodiments of the present invention, the complexing agent may include, per 1 liter of the electroless nickel plating solution: tartaric acid in the range of 5 g to 20 g; a sum of lactic acid and citric acid in the range of 5 g to 20 g; and glycine in the range of 5 g to 100 g.

In some embodiments of the present invention, the cyan-based stabilizer may include at least one of sodium thiocyanate (NaSCN), potassium thiocyanate (KSCN), sodium cyanide (NaCN), or potassium cyanide (KCN); and the cyan-based stabilizer may be included in the range of 0.1 ppm to 5 ppm per 1 liter of the electroless nickel plating solution.

In some embodiments of the present invention, a metal stabilizer that provides stability to the electroless nickel plating solution, prevents a reduction reaction of the nickel ion used for plating, and contains metal atoms may be further included. The metal stabilizer may be included in the range of 0.1 ppm to 20 ppm per 1 liter of the electroless nickel plating solution.

In some embodiments of the present invention, the metal stabilizer may include at least one of tin (Sn), zinc (Zn), magnesium (Mg), lead (Pb), cadmium (Cd), thorium (Th), thallium (Tl), selenium (Se), tellurium (Te), molybdenum (Mo), arsenic (As), or bismuth (Bi).

In some embodiments of the present invention, a pH control agent that controls the pH of the electroless nickel plating solution to be in the range of 3.5 to 5.5 may be further included.

In some embodiments of the present invention, the pH control agent may include at least one of sulfuric acid, hydrochloric acid, nitric acid, ammonium hydroxide, sodium hydroxide, or potassium hydroxide.

An electroless nickel plating method that uses an electroless nickel plating solution according to a technical concept of the present invention for achieving the technical object includes preparing the electroless nickel plating solution described above; and immersing an object to be plated in the electroless nickel plating solution to form a flexible nickel plated layer on the object to be plated.

In some embodiments of the present invention, the forming of the flexible nickel plated layer may be performed at a pH in the range of 3.5 to 5.5.

In some embodiments of the present invention, the forming of the flexible nickel plated layer may be performed at a temperature in the range of 70° C. to 95° C.

In some embodiments of the present invention, the forming of the flexible nickel plated layer may be performed at a plated layer formation rate of at least 15 μm per hour.

A flexible nickel plated layer according to a technical concept of the present invention for achieving the technical object is formed on a surface of an object to be plated through an electroless nickel plating method by using the electroless nickel plating solution described above.

In some embodiments of the present invention, the flexible nickel plated layer may have a composite structure in which at least two of an amorphous structure, a columnar crystal structure, a granular crystal structure, or a bulk crystal structure are mixed.

In some embodiments of the present invention, the flexible nickel plated layer may have a hardness of at least 500 Hv.

In some embodiments of the present invention, the flexible nickel plated layer may have a number of bending cycles of at least 500 cycles.

Advantageous Effects

An electroless nickel plating solution according to a technical concept of the present invention is constituted to include sulfamic acid nickel as a nickel salt, a reducer such as sodium hydrophosphite, a complexing agent such as adipic acid, citric acid, tartaric acid, lactic acid, or glycine, and a cyan-based stabilizer and to improve the stability of the plating solution, and may form the flexible nickel plated layer in which the desired level of hardness and flexibility in the plated layer may both be realized at the same time. Moreover, since a high plated layer formation rate may be provided, and there is almost no change in the properties of the plated layer, even when the number of times the plating solution is used increases, a superb effect in gaining economic competitiveness may be provided.

In particular, the flexible nickel plated layer formed according to a technical concept of the present invention has a superb flexibility, such as a number of cycles before failure being at least 500 cycles, such that the occurrence of cracks or failure due to bending or stress may be prevented, and thus the flexible nickel plated layer may be applied to a flexible printed circuit board, provide excellent coverage properties with respect to a copper line, and provide a uniform plate thickness to an edge region having poor coverage properties.

The above described advantageous effects of the present invention are merely disclosed as examples, and do not limit the scope of the present invention.

MODE FOR INVENTION

Figure 1:
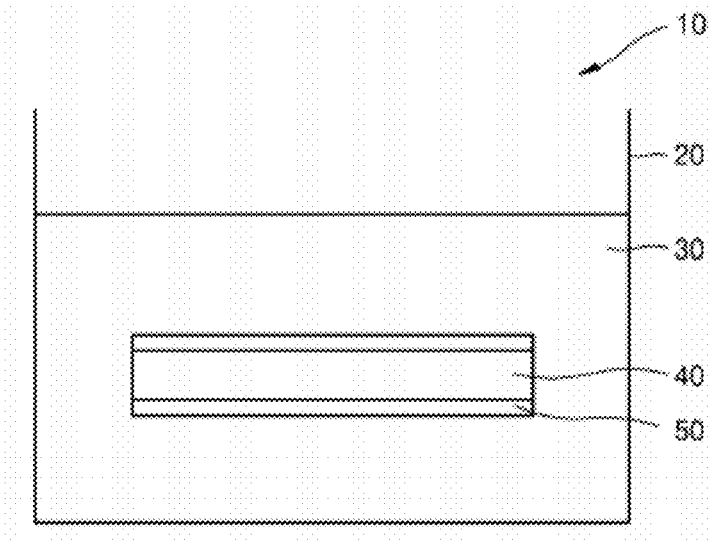
FIG. 1 is a schematic diagram illustrating a plating apparatus that uses an electroless nickel plating solution according to an embodiment of the present invention.

Hereinafter, an exemplary embodiment of the present invention will be described in detail with reference to the accompanying drawings. The embodiments of the present invention are provided to more clearly describe the technical concept to those with ordinary skill in the art. The below embodiments may be modified into various forms, and the technical concept of the present invention is not limited to the below embodiments. Rather, these embodiments are provided to improve the reliability and completeness of the present disclosure, and to better convey the technical concept of the present invention to those with ordinary skill in the art. As used in the present specification, the term "and/or" includes any one in a list of items, and also includes all combinations of one or more items in the list. Like reference numerals denote like elements throughout. Moreover, the various elements and regions in the drawings are drawn schematically. Thus, the technical concept of the present invention is not limited by the relative sizes or gaps shown in the accompanying drawings.

FIG. 1 is a schematic diagram illustrating a plating apparatus that uses an electroless nickel plating solution according to an embodiment of the present invention.

Referring to FIG. 1, the plating apparatus 10 accommodates an electroless nickel plating solution 30 in a plating bath 20, and forms a flexible nickel plated layer 50 on an object to be plated 40 by immersing the object to be plated 40 in the electroless nickel plating solution 30. Moreover, the case of using a plating solution that includes another metal other than the electroless nickel plating solution 30 is also included in the technical concept of the present invention.

The electroless nickel plating solution 30 includes a solvent and a nickel metal salt that is dissolved in the solvent, a reducer, a complexing agent, and a cyan-based stabilizer. Moreover, the electroless nickel plating solution 30 may further include a metal stabilizer. In addition, the nickel plating solution 30 may further include a pH control agent.

Moreover, the electroless nickel plating solution 30 may further include a supplementary additive composed of an organic compound or an inorganic compound in order to control the plating rate and improve the glossy property. In addition, the electroless nickel plating solution 30 may further include a surfactant in order to improve the interfacial properties between a matrix layer and the flexible nickel plated layer 50, and to prevent the formation of pits.

The object to be plated 40 may include a metal or a polymer material. The object to be plated 40 may include, for example, copper or iron. The object to be plated 40 may refer to a metal line formed on a flexible circuit board, and the metal line may include, for example, copper.

The electroless nickel plating solution 30 may have a pH in the range of about 3.5 to about 5.5, and a forming operation of the nickel plated layer may be performed at a temperature in the range of about 70° C. to about 95° C. The pH range and temperature range minimize chemical effects such as deformation or corrosion that may occur in the object to be plated 40, and are set such that the flexible nickel plated layer 50 may be more easily formed on the surface of the object to be plated 40. In particular, in the above pH range and temperature range a spontaneous decomposition of the electroless nickel plating solution 30 may be prevented to keep the electroless nickel plating solution 30 more stable, the flexible nickel plated layer 50 may be more easily precipitated and thereby formed, pit formation in the electroless nickel plated layer 50 may be prevented, and the formation of crystal grains may be prevented or reduced.

Hereinafter, detailed description will be given about constituent elements constituting the electroless nickel plating solution 30.

The solvent may constitute most of the electroless nickel plating solution 30 into which the object to be plated is immersed 40. The solvent may include a material that dissolves the nickel metal salt, the reducer, the complexing agent, the metal stabilizer, the pH control agent, and the cyan-based stabilizer. The solvent may be, for example, water. However, this is an example and the technical concept of the present invention is not limited thereto.

The nickel metal salt may be dissolved in the solvent. The nickel metal salt may provide a nickel ion used for plating the object to be plated 40, and the nickel ion used for plating may form the flexible nickel plated layer 50 on the object to be plated 40. The nickel metal salt may include metal, and, for example, may include nickel (Ni). Accordingly, the nickel ion used for plating may include a nickel (Ni) ion, and the nickel ion may be, for example, a divalent ion. The nickel metal salt may include, for example, a nickel salt hydrate. For example, the nickel metal salt may include sulfamic acid nickel. Moreover, a case in which the nickel metal salt includes at least one of nickel sulfate, nickel chloride, nickel nitrate, nickel oxide, or nickel carbonate is included in the technical concept of the present invention.

The nickel metal salt may be included in the range of 4 g to 7 g per 1 liter of the electroless nickel plating solution 30. For example, in the case in which the nickel metal salt is sulfamic acid nickel, when the concentration of the sulfamic acid nickel is less than 4 g per liter, the plated layer formation rate may be reduced. When the concentration of the sulfamic acid nickel is greater than 7 g per liter, the stability of the electroless nickel plating solution 30 may be reduced such that the spontaneous decomposition of the electroless nickel plating solution 30 may occur.

The reducer may be dissolved in the solvent. The reducer may reduce the nickel ion used for plating. The reducer may, for example, reduce the nickel ion. The reducer may include at least one of hypophosphite, boron hydride, dimethylamine borane, or hydrazine. The reducer may include, as the hypophosphite, at least one of sodium hypophosphite, potassium hypophosphite, or ammonium hypophosphite. By including such a reducer, the electroless nickel plating solution 30 may include about 7% to about 9% of phosphorus (P).

The reducer may be included in the range of 20 g to 50 g per 1 liter of the electroless nickel plating solution 30. For example, in the case in which the reducer is the sodium hypophosphite, when the concentration of the sodium hypophosphite is less than 20 g per liter, the plated layer formation rate may be reduced. When the concentration of the sodium hypophosphite is greater than 50 g per liter, the stability of the electroless nickel plating solution 30 may be reduced such that the spontaneous decomposition of the electroless nickel plating solution 30 may occur.

The complexing agent may be dissolved in the solvent. The complexing agent may form the nickel ion used for plating and a complex. For example, the complexing agent may bond with the nickel ion to form a nickel complex. Since the stability of the electroless nickel plating solution 30 and the properties of the flexible nickel plated layer 50 are greatly modified according to the type and amount of the complexing agent, selecting the type and amount of the complexing agent according to the use purpose and use is extremely important. The complexing agent may control the plated layer formation rate, prevent the electroless nickel plating solution 30 from spontaneously decomposing, and control the plating reaction such that the reduction reaction of nickel may easily occur on the surface of the object to be plated 40. The complexing agent may, as an organic acid or a salt thereof, control the total amount of the nickel ion participating in the reduction reaction, and prevent the nickel ion from bonding with the phosphorus to be precipitated as nickel phosphate, and may thereby perform the function of enabling the electroless nickel plating solution 30 to maintain stability during the plating operation. Moreover, by reducing the rapid generation of a hydrogen ion due to the reduction reaction, the complexing agent may prevent the pH of the electroless nickel plating solution from rapidly changing.

The complexing agent may include at least one of carboxylic acid, alpha hydroxyl acid (AHA), or amino acid. The complexing agent may include, for example, at least one carboxylic acid having a carboxyl group (COOH), or a derivative thereof. The complexing agent may include at least one alpha hydroxyl acid (AHA) in which some of the carboxyl groups (COOH) are substituted with hydroxyl groups (OH), or a derivative thereof. The complexing agent may include at least one amino acid, which includes both a carboxyl group (COOH) and an amino group (NH), or a derivative thereof.

The carboxylic acid may stabilize the electroless nickel plating solution 30 while improving the plated layer formation rate. The alpha hydroxyl acid does not have a large effect on the stability of the plating solution or the plated layer formation rate when added to the electroless nickel plating solution 30 as the lone component, but conversely, stabilizes the electroless nickel plating solution 30 and has a role of increasing the plated layer formation rate when added together with at least two kinds of complexing agents to the electroless nickel plating solution 30.

The complexing agent, as the carboxylic acid or derivative thereof, may include, for example, at least one of acetic acid, adipic acid, formic acid, propionic acid, butyric acid, valeric acid, caproic acid, enanthic acid, caprylic acid, pelargonic acid, capric acid, undecylic acid, lauric acid, tridecylic acid, myristic acid, pentadecanoic acid, palmitic acid, margaric acid, stearic acid, arachidic acid, oxalic acid, malonic acid, tartaric acid, succinic acid, glutaric acid, pimelic acid, suberic acid, azelaic acid, sebacic acid, orthophthalic acid, isophthalic acid, terephthalic acid, taleic acid, fumaric acid, glutaconic acid, traumatic acid, or muconic acid.

Moreover, the complexing agent, as the alpha hydroxyl acid or derivative thereof, may include, for example, at least one of glycolic acid, lactic acid, citric acid, or mandelic acid.

Moreover, the complexing agent, as the amino acid or derivative thereof, may include, for example, at least one of, glycine, alanine, phenylalanine, serine, tyrosine, valine, aspartic acid, glutamic acid, threonine, methionine, arginie, leucine, Isoleucine, lysine, proline, tryptophan, histidine, cystine, aspartate, or slutamate.

The complexing agent may be included in the range of 15 g to 140 g per 1 liter of the electroless nickel plating solution 30. For example, the complexing agent may be included in the range of 40 g to 80 g per 1 liter of the electroless nickel plating solution 30. When the concentration of the complexing agent is less than 40 g per liter, the stability of the electroless nickel plating solution 30 may be reduced such that the spontaneous decomposition of the electroless nickel plating solution 30 may occur. When the concentration of the complexing agent is greater than about 80 g per liter, the stability of the electroless nickel plating solution 30 is increased, but the plated layer formation rate may be reduced. When the plated layer formation rate is reduced, the production time may be increased such that the economic competitiveness and product properties are degraded, and as the metal turn over increases, the decomposed complexing agent may exist in the electroless nickel plating solution 30 as a suspended matter to reduce the lifetime of the electroless nickel plating solution 30. The complexing agent may be composed of mixtures in which various kinds of materials are mixed according to the use purpose and according to the properties of the object to be plated, and for example, 2 to 5 kinds of materials may be mixed.

For example, the complexing agent may include, per 1 liter of the electroless nickel plating solution 30, the carboxylic acid or derivative thereof in the range of 5 g to 20 g, the alpha hydroxyl acid or derivative thereof in the range of 5 g to 20 g, and the amino acid or derivative thereof in the range of 5 to 100 g. For example, the complexing agent may include the amino acid or derivative thereof in the range of 20 g to 50 g per 1 liter of the electroless nickel plating solution 30.

For example, the complexing agent may include, per 1 liter of the electroless nickel plating solution 30, a sum of adipic acid and tartaric acid, which are derivatives of the carboxylic acid, in the range of 5 g to 20 g, lactic acid, which is the alpha hydroxyl acid, in the range of 5 g to 20 g, and glycine, which is the amino acid, in the range of 5 g to 100 g.

Moreover, for example, the complexing agent may include, per 1 liter of the electroless nickel plating solution 30, tartaric acid, which is a derivative of the carboxylic acid, in the range of 5 g to 20 g, a sum of lactic acid and citric acid, which are the alpha hydroxyl acid, in the range of 5 g to 20 g, and glycine, which is the amino acid, in the range of 5 g to 100 g.

For example, the complexing agent may include, per 1 liter of the electroless nickel plating solution 30, about 5 g of citric acid, about 5 g of tartaric acid, about 10 g of lactic acid, and about 40 g of glycine. Moreover, the complexing agent may include, per 1 liter of the electroless nickel plating solution 30, about 5 g of tartaric acid, about 5 g of citric acid, about 10 g of lactic acid, and about 40 g of glycine.

The cyan-based stabilizer may perform a function of improving the properties of the flexible nickel plated layer 50 by providing stability to the electroless nickel plating solution 30, preventing the generation of pits in the flexible nickel plated layer 50, and controlling the roughness of the flexible nickel plated layer 50 and providing glossiness. The cyan-based stabilizer may include, for example, a cyan-based compound. The cyan-based stabilizer may include, for example, at least one of sodium thiocyanate (NaSCN), potassium thiocyanate (KSCN), sodium cyanide (NaCN), or potassium cyanide (KCN).

The cyan-based stabilizer may be included in the range of 0.1 ppm to 5 ppm per 1 liter of the electroless nickel plating solution 30. That is, the cyan-based stabilizer may be included in the range of 0.1 mg to 5 mg per 1 liter of the electroless nickel plating solution 30. When the cyan-based stabilizer is less than 0.1 ppm, the effects of the glossiness or the increase in the plating formation rate may be absent.

When the cyan-based stabilizer is greater than 5.0 ppm, the plated layer formation rate may be reduced.

Hereinafter, description will be about given about the metal stabilizer included in the electroless nickel plating solution 30. The metal stabilizer performs a function of improving the properties of the flexible nickel plated layer 50 by providing stability to the electroless nickel plating solution 30, controlling the roughness of, and providing glossiness to, the flexible nickel plated layer 50, and in particular, by preventing the reduction reaction of the nickel ion.

When electroless nickel plating, the reduction reaction of the nickel ion used for plating, for example nickel, must be controlled to allow the precipitation rate to be predicted, and the reduction reaction must be controlled such that the reaction occurs only on the surface of the object to be plated. To realize this, the stabilizer that suppresses the reduction reaction may be added to the electroless nickel plating solution 30.

Since the nickel plating solution excluding such a stabilizer is itself unstable, nickel may be spontaneously precipitated in the nickel plating solution or on a wall of the plating bath, and thereby the inherent function of the nickel plating solution may be lost. Such decomposition of the nickel plating solution may be initiated by colloid particles or suspended particles present in the nickel plating solution, and the particles may be formed when impurities are introduced from the outside or the concentration of the reducer exceeds the solubility limit. Since the particles have a very large specific surface area and thus may act as a catalyst in the reduction reaction to propagate the reaction such that the nickel is precipitated, while at the same time causing a large quantity of hydrogen gas to be released by the reduction reaction such that a fine, black precipitate is formed, the plating quality may be degraded. The metal stabilizer that includes metal elements is used in order to suppress the occurrence of the reduction reaction other than on the surface of the object to be plated, and representative examples thereof being used include a lead (P) compound and a cadmium (Cd) compound, and the like. When lead (P) or cadmium (Cd) are added as the metal stabilizer included in the nickel plating solution, the glossiness of the plated layer formed on the object to be plated is high and the stability of the nickel plating solution is improved, and thus lead and cadmium have been widely used.

The metal stabilizer may be dissolved in the solvent. The metal stabilizer may suppress the reduction reaction of the nickel ion used for plating. In particular, the metal stabilizer may perform the function of stabilizing the electroless nickel plating solution 30 by suppressing the reduction reaction in regions other than a region in which the forming of the flexible nickel plated layer 50 on the object to be plated 40 is desired. The metal stabilizer may include at least one of a metal element, which is the metal itself, a metal salt including the metal element, a metal oxide including the metal element, or a metal sulfide including the metal element. The metal stabilizer may include, for example, at least one tin (Sn), zinc (Zn), magnesium (Mg), lead (Pb), cadmium (Cd), thorium (Th), thallium (Tl), selenium (Se), tellurium (Te), molybdenum (Mo), arsenic (As), or bismuth (Bi).

In order to prevent the metal stabilizer from being isolated in the electroless nickel plating solution 30 to act as an impurity, the metal stabilizer may be pre-dissolved in a strong acidic solution such as hydrochloric acid or nitric acid, or a strong basic solution such as caustic soda solution, and then added to the electroless nickel plating solution 30. The metal stabilizer, for example, may be pre-dissolved in an alkyl sulfonate solution and then added to the electroless nickel plating solution 30. The stabilizer, for example, may be pre-dissolved in, among the alkyl sulfonate solution, methanesulfonate solution. In this case, improvement may be exhibited in the plated layer properties such as glossiness, and the like.

The metal stabilizer may be included in the range of 0.1 ppm to 20 ppm per 1 liter of the electroless nickel plating solution 30. That is, the metal stabilizer may be included in the range of 0.1 mg to 20 mg per 1 liter of the electroless nickel plating solution 30. When the concentration of the metal stabilizer is less than 0.1 ppm, the stability of the electroless nickel plating solution 30 may be reduced and the glossiness of the plated layer may be reduced, and when the concentration of the metal stabilizer is greater than 20 ppm, the plated layer formation rate may be greatly reduced or the properties of the flexible nickel plated layer 50 may be degraded.

The pH control agent may be dissolved in the solvent. Since the plated layer formation rate and plated layer thickness of the flexible nickel plated layer 50 formed on the object to be plated 40 are influenced by the pH of the electroless nickel plating solution 30, it is desirable to add a material capable of maintaining and controlling a constant pH of the electroless nickel plating solution 30. Therefore, the pH control agent may be added to the electroless nickel plating solution 30 as the material that performs such a function. The pH control agent may control the pH of the electroless nickel plating solution. The pH control agent may include an acidic material such as sulfuric acid, hydrochloric acid, or nitric acid, and the like, or include a basic material such as ammonium hydroxide, sodium hydroxide, or potassium hydroxide, and the like.

The content of the pH control agent added to the nickel plating solution may be adjusted to maintain the pH of the electroless nickel plating solution 30 in the range of 3.5 to 5.5. When the pH range of the electroless nickel plating solution 30 is 3.5 to 5.5, the electroless nickel plating solution 30 may be kept even more stable, and a high quality of the flexible nickel plated layer 50 may be obtained while maintaining a high plated layer formation rate.

Figure 2:
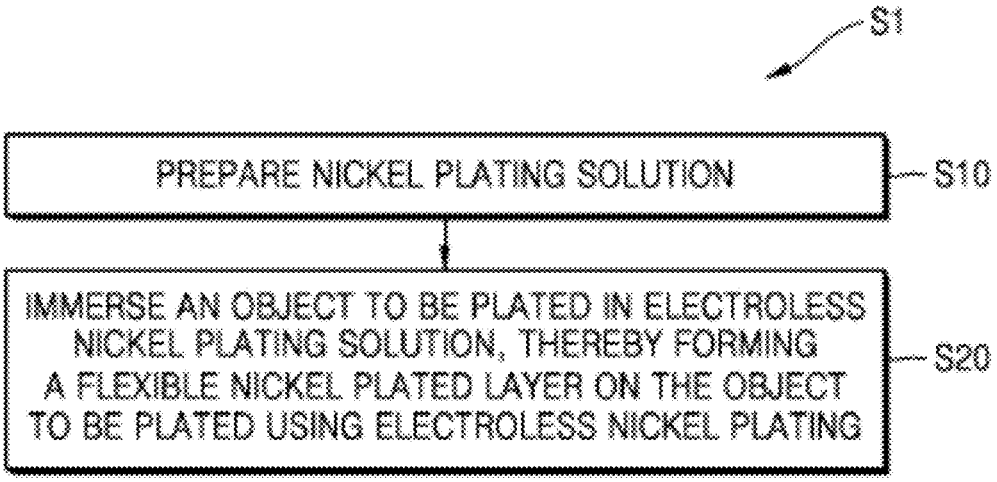
FIG. 2 is a flow chart illustrating an electroless nickel plating method that uses an electroless nickel plating solution according to an embodiment of the present invention.

FIG. 2 is a flow chart illustrating an electroless nickel plating method S1 that uses an electroless nickel plating solution according to an embodiment of the present invention.

Referring to FIG. 2, the electroless nickel plating method S1, as described above, includes a step S10 of preparing the electroless nickel plating solution and a step S20 of immersing the object to be plated in the electroless nickel plating solution to thereby form the flexible nickel plated layer on the object to be plated using electroless nickel plating.

The step S20 of forming the flexible nickel plated layer may be performed at a pH in the range of 3.5 to 5.5. The step S20 of forming the flexible nickel plated layer may be performed at a temperature in the range of 70° C. to 95° C.

EXPERIMENTAL EXAMPLE

In order to examine the properties of the electroless nickel plating solution according to a technical concept of the present invention, the formation of a flexible nickel plated layer was performed using electroless nickel plating.

In the electroless nickel plating solution according to a technical concept of the present invention, water was used as a solvent, about 5 g of sulfamic acid nickel was added per 1 liter of the electroless nickel plating solution as a nickel metal salt, and about 25 g of sodium hypophosphite was added per 1 liter of the electroless nickel plating solution as a reducer. The complexing agent added to the solvent was formed to include, per 1 liter of the electroless nickel plating solution, about 40 g of glycine, about 10 g of lactic acid, about 5 g of tartaric acid, and about 5 g of adipic acid. An equivalent content of citric acid may be added instead of the adipic acid.

Moreover, about 1 ppm of thallium (Tl) was added per 1 liter of the electroless nickel plating solution as a metal stabilizer, and 0.5 ppm of sodium thiocyanate (NaSCN) was added per 1 liter of the electroless nickel plating solution as a cyan-based stabilizer. The stabilizers were pre-dissolved in a solvent such as alkyl sulfonate and then added. Moreover, the metal stabilizer and the cyan-based stabilizer must be separately dissolved and then added in order to be prevented from acting as an impurity in the electroless nickel plating solution.

In addition, since there is a possibility of the electroless nickel plating solution being easily decomposed when the sulfamic acid nickel and the sodium hypophosphite are dissolved at the same time, the sodium hydrophosphite was added first to the complexing agent to prepare a solution, after which the sulfamic acid nickel was added to form the electroless nickel plating solution.

The pH of the electroless nickel plating solution was maintained at about 4.5 by using ammonium hydroxide, and in order to replenish the nickel plating solution, the nickel plating solution was replenished by performing an analysis of the nickel salt concentration every 30 minutes.

In addition, electroless nickel plating solutions used as comparative examples were one kind of commercialized regular electroless nickel plating solution (hereinafter referred to as Comparative Example 1) and two kinds of commercialized high-flexibility electroless nickel plating solutions (hereinafter referred to as Comparative Example 2 and Comparative Example 3). Here, "highly-flexible" indicates that the formed plated layer has a high flexibility, and is noted to have the same meaning as the term "flexible" in the present specification.

An object to be plated using the electroless nickel plating solution according to a technical concept of the present invention, and the electroless nickel plating solutions of the comparative examples were prepared through the following process.

A printed circuit board on which a copper layer was formed underwent immersion treatment for 1 minute using about 10% sulfuric acid. A copper oxide film was removed from the copper layer through the immersion treatment. The printed circuit board was washed with distilled water (deionized water). In order to improve the adhesion of the nickel plated layer, a soft etching treatment and a washing treatment were performed for about 2 minutes at a temperature range of about 20° C. to about 30° C. After performing for 1 minute a lead activation treatment for forming the nickel plated layer, a washing treatment was performed to thereby prepare the object to be plated.

Next, the object to be plated was plated by being immersed in the electroless nickel plating solution to form the nickel plated layer. The temperature of the nickel plated layer during the plating was maintained constant at about 85° C. in a heating bath, and the pH of the electroless nickel plating solution was maintained constant at about 4.5 using the ammonium hydroxide. In order to replenish the electroless nickel plating solution, the electroless nickel plating solution was replenished by performing the analysis of the nickel salt every 30 minutes. Replenishment of the electroless nickel plating solution was performed by replenishing the nickel salt, the reducer, and the complexing agent.

For bending testing of the nickel plated layer that was formed, the nickel plated layer was formed using the nickel plating solution to a thickness of about 5 μm on a coupon used for bending testing. The bending test was performed under a load of 500 g, an angle of 135 degrees, and a bending rate of 175. For tensile testing in order to measure the percent elongation of the nickel plated layer, the nickel plated layer was formed to a thickness of about 25 μm. For observing the cross-sectional appearance of the nickel plated layer, the nickel plated layer was formed on copper and then brittle fractured.

Table 1 is a table showing the properties of the flexible nickel plated layer formed using the electroless nickel plating solution according to the Example of the present invention, and the properties of the nickel plated layer formed using electroless nickel plating solutions of the Comparative Examples. Comparative Example 1 is the case in which a commercialized regular electroless nickel plating solution was used, and Comparative Example 2 and Comparative Example 2 are each a case in which a commercialized high-flexibility nickel plating solution was used.

TABLE 1

| | Example | Comparative Example 1 | Comparative Example 2 | Comparative Example 3 |
|---|---|---|---|---|
| Plated layer formation rate [μm/hour] | 15~20 | 13~17 | 8~12 | 8~10 |
| Precipitated amount of phosphorus [wt %] | 7.3 | 9.43 | 10.2 | 8.3 |
| Density [g/cm$^3$] | 7.91 | 7.88 | 7.9 | 7.6 |
| Surface roughness [μm] | 0.57 | 0.3 | 0.72 | 0.65 |
| Hardness [100 g/f] | 566 | 491 | 445 | 495 |
| Percent elongation [%] | 0.69 | 0.14 | 0.58 | 0.39 |
| Number of bending cycles [cycles] | 550 | 19 | 386 | 406 |

Referring to Table 1, the Example of the present invention exhibits a plated layer formation rate of 15 μm/hour to 20 μm/hour, thus exhibiting a faster plated layer formation rate compared to Comparative Example 2 and Comparative Example 3, which are the cases of the high-flexibility nickel plating solution, and a similar or faster plated layer formation rate compared to Comparative Example 1, which is the case of the regular nickel plating solution. Thus, compared to the Comparative Examples, the Example of the present invention may achieve a high plated layer formation rate.

In all four cases, the precipitated amount of phosphorus was in the range of 7 wt % to 10 wt %, and thus an intermediate phosphorus type nickel plated layer was formed.

In all four cases, the density was in the range of 7.5 g/cm$^3$ to 8 g/cm$^3$, and at 7.6 g/cm$^3$, the density was relatively low in the Example of the present invention.

The surface roughness observed in the Example was 0.57 μm, and thus higher than the surface roughness of 0.3 μm observed in Comparative Example 1, which is the case of the regular nickel plating solution, but lower than the surface roughness of 0.72 μm observed in Comparative Example 2 and the surface roughness of 0.65 μm observed in Comparative Example 3, which are the cases of the high-flexibility nickel plating solution. Therefore, the Example of the present invention exhibited a superb surface roughness property among the high-flexibility nickel plating solutions.

The Example of the present invention exhibited superior properties when compared to the Comparative Examples for all of the hardness, the percent elongation, and the number of bending cycles until failure.

The hardness observed in the Example of the present invention was 566 Hv, and thus higher than the hardness of less than 500 Hv observed in the Comparative Examples, such as the hardness of 491 Hv observed in Comparative Example 1, the hardness of 455 Hv observed in Comparative Example 2, and the hardness of 495 Hv observed in Comparative Example 3. When compared to Comparative Example 2 and Comparative Example 3, which are the cases of the high-flexibility nickel plating solution, the Example of the present invention exhibited an increase in the hardness of 27% and 14%, respectively.

The percent elongation observed in the Example of the present invention was 0.69%, and thus higher than the percent elongation of less than 0.6% observed in the Comparative Examples, such as the percent elongation of 0.14% observed in Comparative Example 1, the percent elongation of 0.58% observed in Comparative Example 2, and the percent elongation of 0.39% observed in Comparative Example 3. When compared to Comparative Example 2 and Comparative Example 3, which are the cases of the high-flexibility nickel plating solution, the Example of the present invention exhibited an increase in the percent elongation of 19% and 77%, respectively.

The number of cycles until failure observed in the Example of the present invention was 550 cycles, and thus higher than the number of cycles until failure of 19 cycles observed in Comparative Example 1, the number of cycles until failure of 386 cycles observed in Comparative Example 2, and the number of cycles until failure of 406 cycles observed in Comparative Example 3. When compared to Comparative Example 2 and Comparative Example 3, which are the cases of the high-flexibility nickel plating solution, the Example of the present invention exhibited an increase in the number of cycles until failure of 43% and 35%, respectively.

Figure 3:
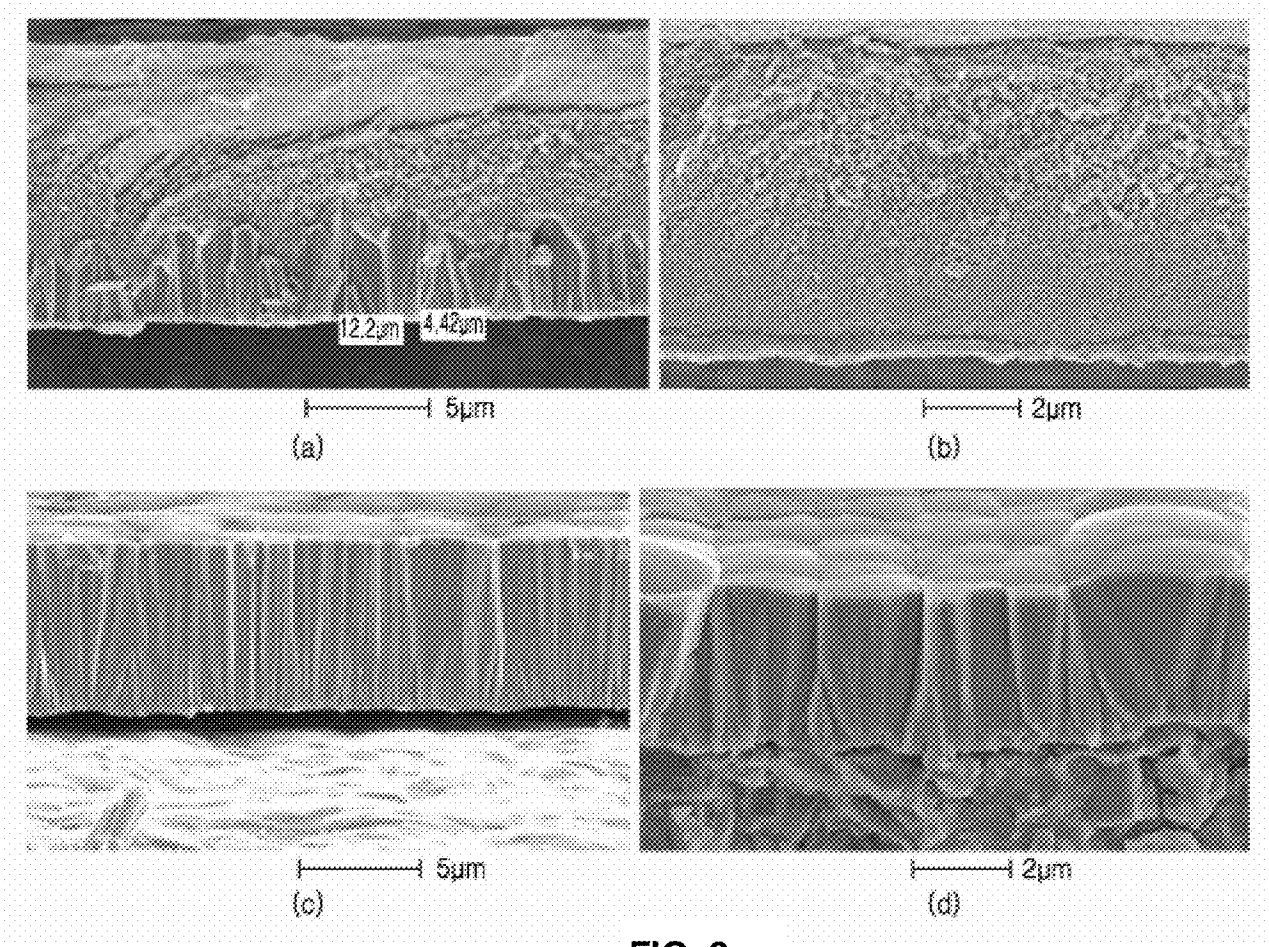
FIG. 3 shows scanning electron microscope images of cross-sections of a flexible nickel plated layer formed by using an electroless nickel plating solution according to an embodiment of the present invention, and of nickel plated layers formed by using electroless nickel plating solutions of Comparative Examples.

FIG. 3 shows scanning electron microscope images of cross-sections of the flexible nickel plated layer formed by using the electroless nickel plating solution according to the Example of the present invention, and of the nickel plated layers formed by using electroless nickel plating solutions of the Comparative Examples. Specifically, (a) in FIG. 3 is an image of the Example of the present invention, (b) in FIG. 3 is an image showing Comparative Example 1, (c) in FIG. 3 is an image showing Comparative Example 2, and (d) in FIG. 3 is an image showing Comparative Example 3.

Referring to FIG. 3, Comparative Example 1, which is the case of the regular nickel plating solution, did not exhibit a fixed growth direction and instead exhibited the nickel plated layer that was formed as an amorphous structure (or an equiaxed crystal structure). Comparative Example 2 and Comparative Example 3, which are the cases of the high-flexibility nickel plating solution, exhibited the nickel plated layer that was formed as a columnar crystal structure. Conversely, the Example of the present invention exhibited a composite structure in which the initial growth had a columnar crystal structure similar to the Comparative Example 2 and Comparative Example 3, which are the cases of the high-flexibility nickel plating solution, and the later growth had an amorphous structure (or an equiaxed crystal structure) similar to Comparative Example 1, which is the case of the regular nickel plating solution. Moreover, the flexible nickel plated layer according to the Example of the present invention may have the composite structure in which at least two of an amorphous structure, a columnar crystal structure, a granular crystal structure, or a bulk crystal structure are mixed. In such a composite structure, the ratio of the crystalline structure, such as the columnar crystal structure, to the amorphous structure (or equiaxed crystal structure) may be controlled according to the type and mixing ratio of the complexing agent contained in the electroless nickel plating solution. The nickel plated layer with such a composite structure is analyzed as having an effect on the increase in hardness, the increase in percent elongation, and the increase in the number of bending cycles. For example, the percent elongation may be increased by the crystalline structure, and the hardness and soldering properties may be improved by the amorphous structure (or equiaxed crystal structure).

Figure 4:
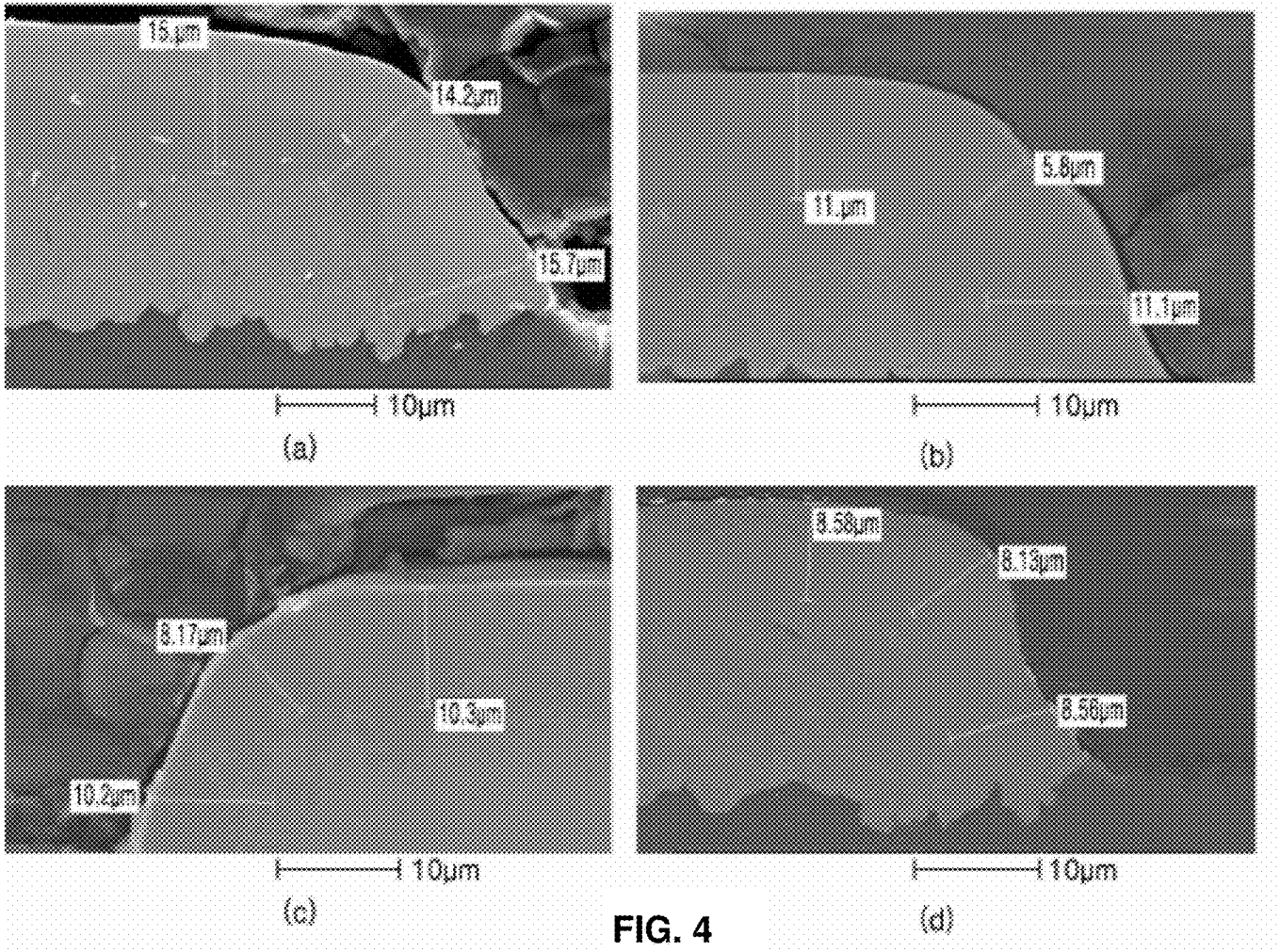
FIG. 4 shows scanning electron microscope images of cross-sections of a flexible nickel plated layer formed by using an electroless nickel plating solution according to an embodiment of the present invention, and of nickel plated layers formed by using electroless nickel plating solutions of Comparative Examples.

FIG. 4 shows scanning electron microscope images of cross-sections of the flexible nickel plated layer formed by using the electroless nickel plating solution according to the Example of the present invention, and of the nickel plated layers formed by using the electroless nickel plating solutions of Comparative Examples. Specifically, (a) in FIG. 4 is an image of the Example of the present invention, (b) in FIG. 4 is an image showing Comparative Example 1, (c) in FIG. 4 is an image showing Comparative Example 2, and (d) in FIG. 4 is an image showing Comparative Example 3. The nickel plated layers in FIG. 4 were formed by plating on the copper line of a printed circuit board.

Referring to FIG. 4, in Comparative Example 1, which is the case of the regular nickel plating solution, a relatively thin nickel plated layer was formed on an edge of the copper line, and in Comparative Example 2 and Comparative Example 3, which are the case of the high-flexibility nickel plating solution, a somewhat uniform nickel plated layer was formed, even on the edge. The flexible nickel plated layer according to the Example of the present invention exhibited an almost completely uniform thickness between the top surface and side of the copper line, and the edge of the copper line, and exhibited the best coverage.

Figure 5:
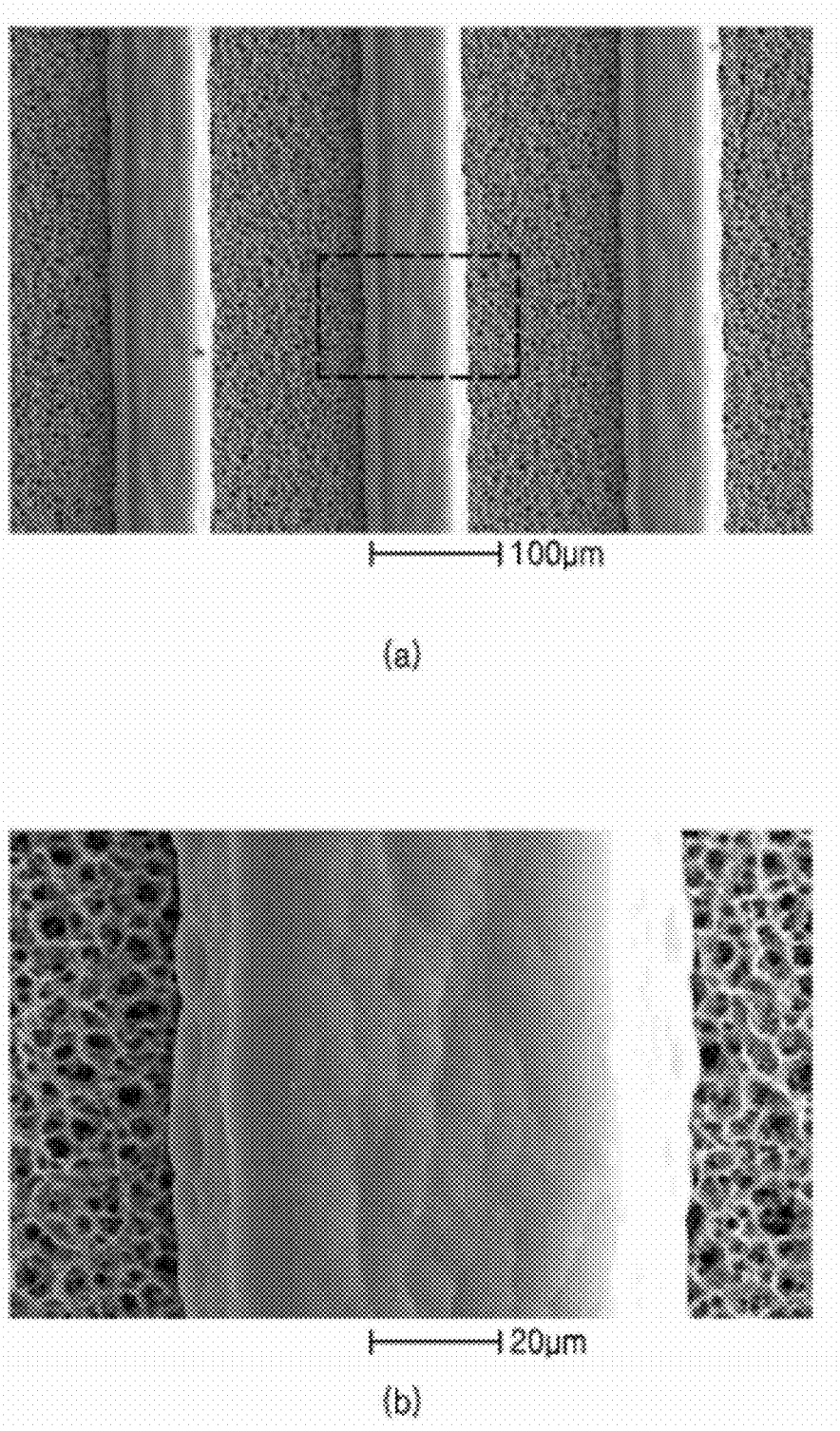
FIG. 5 shows scanning electron microscope images of a top surface of a flexible nickel plated layer formed by using an electroless nickel plating solution according to an embodiment of the present invention.

FIG. 5 shows scanning electron microscope images of the top surface of the flexible nickel plated layer formed by using the electroless nickel plating solution according to the Example of the present invention. Specifically, (b) in FIG. 5 is an enlarged image of the rectangular dotted line region of (a), which shows the Example of the present invention.

Referring to FIG. 5, it may be known that the flexible nickel plated layer according to the Example of the present invention may be selectively formed on the copper line. Moreover, it may be known that the coverage in covering the copper line is excellent.

Figure 6:
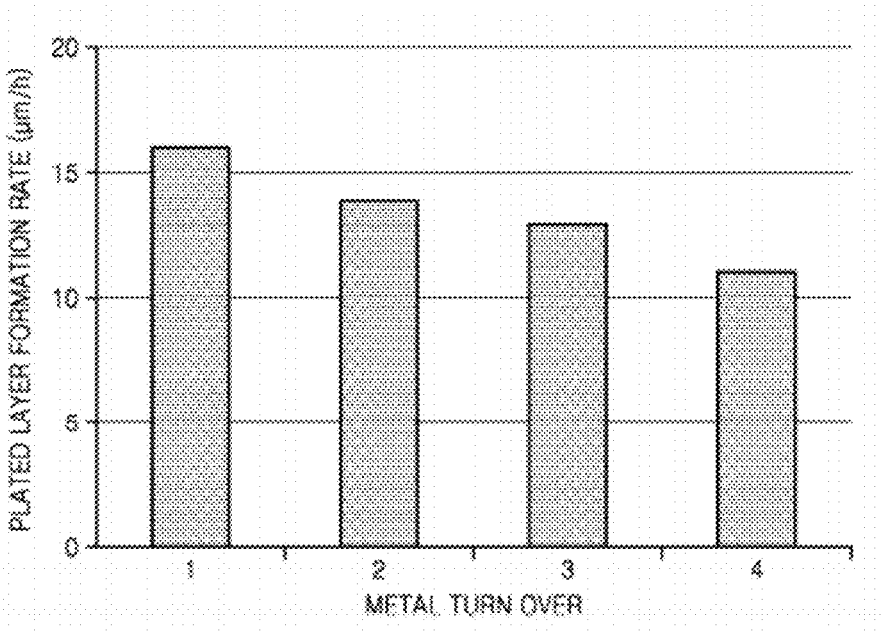
FIG. 6 is a graph illustrating, according to metal turn over (MTO), a plating formation rate obtained in a process of plating an object to be plated by using an electroless nickel plating solution according to an embodiment of the present invention.

FIG. 6 is a graph illustrating, according to metal turn over (MTO), the plating formation rate obtained in the process of plating an object to be plated by using the electroless nickel plating solution according to the Example of the present invention. In the present specification, "metal turn over" indicates the repeated number of times the electroless nickel plating solution was used.

Referring to FIG. 6, the plated layer formation rate decreases as the metal turn over increases. Since the electroless nickel plating solution according to the Example of the present invention may provide up to 4 cycles of the metal turn over, provide a plated layer formation rate of 16 μm/hour for the first metal turn over, and even provide a plated layer formation rate of 11 μm/hour for 4 cycles of the metal turn over, economic competitiveness may be gained such that commercial application is possible. As a point of reference, commercialized high-flexibility electroless nickel plating solutions are known as providing a metal turn over of 3 cycles or 4 cycles.

Table 2 is a table showing the number of bending cycles of the flexible nickel plated layer formed using the nickel plating solution according to the Example of the present invention while increasing the metal turn over.

TABLE 2

| Metal turn over | 1 | 2 | 3 | 4 |
|---|---|---|---|---|
| Number of bending cycles [cycles] | 550 | 680 | 520 | 640 |

Referring to Table 2, the number of bending cycles until failure was observed to be over 500 cycles irrespective of the metal turn over. Consequently, the electroless nickel plating solution according to the Example of the present invention may form the flexible nickel plated layer having an excellent measured value of the number of bending cycles until failure, up to at least 4 cycles of metal turn over.

The technical concept of the present invention described above is not limited to the above embodiments and accompanying drawings, and it will be clear to a person with ordinary skill in the art pertaining to the technical concept of the present invention that various substitutions, modifications, and changes may be made therein without departing from the technical concept of the present invention.

What is claimed is:

1. An electroless nickel plating solution that forms a flexible nickel plated layer by using an electroless nickel plating method, the electroless nickel plating solution comprising:

a nickel metal salt that provides a nickel ion used for plating, and contains sulfamic acid nickel;

a reducer that reduces the nickel ion used for plating;

a complexing agent that forms a complex with the nickel ion used for plating; and a cyan-based stabilizer that provides stability to the electroless nickel plating solution and prevents the generation of pits in the flexible nickel plated layer, wherein the complexing agent comprises, per 1 liter of the electroless nickel plating solution: carboxylic acid or a derivative there in a range of 5 g to 20 g; alpha hydroxyl acid or a derivative thereof in a range of 5 g to 20 g; and amino acid or a derivative thereof in a range of 5 g to 100 g.

2. The electroless nickel plating solution of claim 1, wherein the nickel metal salt is comprised in the range of 4 g to 7 g per 1 liter of the electroless nickel plating solution.

3. The electroless nickel plating solution of claim 1, wherein:

the reducer comprises at least one of sodium hypophosphite, potassium hypophosphite, or ammonium hypophosphite; and the reducer is comprised in the range of 20 g to 50 g per 1 liter of the electroless nickel plating solution.

4. The electroless nickel plating solution of claim 1, wherein:

the complexing agent is comprised in the range of 40 g to 80 g per 1 liter of the electroless nickel plating solution.

5. The electroless nickel plating solution of claim 1, wherein the complexing agent comprises, per 1 liter of the electroless nickel plating solution: a sum of adipic acid and tartaric acid in the range of 5 g to 20 g; lactic acid in the range of 5 g to 20 g; and glycine in the range of 5 g to 100 g.

6. The electroless nickel plating solution of claim 1, wherein the complexing agent comprises, per 1 liter of the electroless nickel plating solution: tartaric acid in the range of 5 g to 20 g; a sum of lactic acid and citric acid in the range of 5 g to 20 g; and glycine in the range of 5 g to 100 g.

7. The electroless nickel plating solution of claim 1, wherein:

the cyan-based stabilizer comprises at least one of sodium thiocyanate (NaSCN), potassium thiocyanate (KSCN), sodium cyanide (NaCN), or potassium cyanide (KCN); and the cyan-based stabilizer is comprised in the range of 0.1 ppm to 5 ppm per 1 liter of the electroless nickel plating solution.

8. The electroless nickel plating solution of claim 1, further comprising a metal stabilizer that provides stability to the electroless nickel plating solution, prevents a reduction reaction of the nickel ion used for plating, and contains metal atoms, wherein the metal stabilizer is comprised in the range of 0.1 ppm to 20 ppm per 1 liter of the electroless nickel plating solution.

9. The electroless nickel plating solution of claim 8, wherein the metal stabilizer comprises at least one of tin (Sn), zinc (Zn), magnesium (Mg), lead (Pb), cadmium (Cd), thorium (Th), thallium (Tl), selenium (Se), tellurium (Te), molybdenum (Mo), arsenic (As), or bismuth (Bi).

10. The electroless nickel plating solution of claim 1, further comprising a pH control agent that controls the pH of the electroless nickel plating solution to be in the range of 3.5 to 5.5.

11. The electroless nickel plating solution of claim 10, wherein the pH control agent comprises at least one of sulfuric acid, hydrochloric acid, nitric acid, ammonium hydroxide, sodium hydroxide, or potassium hydroxide.

12. An electroless nickel plating method that uses an electroless nickel plating solution, the electroless nickel plating method comprising:

preparing the electroless nickel plating solution according to claim 1; and immersing an object to be plated in the electroless nickel plating solution to form a flexible nickel plated layer on the object to be plated.

13. The electroless nickel plating method of claim 12, wherein the forming of the flexible nickel plated layer is performed at a pH in the range of 3.5 to 5.5.

14. The electroless nickel plating method of claim 12, wherein the forming of the flexible nickel plated layer is performed at a temperature in the range of 7° C. to 95° C.

15. The electroless nickel plating method of claim 12, wherein the forming of the flexible nickel plated layer is performed at a plated layer formation rate of at least 15 μm per hour.

16. A flexible nickel plated layer formed on a surface of an object to be plated through an electroless nickel plating method by using the electroless nickel plating solution according to claim 1.

17. The flexible nickel plated layer of claim 16, wherein the flexible nickel plated layer has a composite structure in which at least two of an amorphous structure, a columnar crystal structure, a granular crystal structure, or a bulk crystal structure are mixed.

18. The flexible nickel plated layer of claim 16, wherein the flexible nickel plated layer has a hardness of at least 500 Hv.

19. The flexible nickel plated layer of claim 16, wherein the flexible nickel plated layer has a number of bending cycles of at least 500 cycles.

* * * * *